United States Patent [19]

Sutton et al.

[11] 4,358,524

[45] Nov. 9, 1982

[54] POLYMERIC VEHICLE FOR METALLIZABLE DYE IMAGE-RECEIVING LAYER

[75] Inventors: Richard C. Sutton; David P. Brust; Lewis R. Hamilton, all of Rochester, N.Y.

[73] Assignee: Eastman Kodak Company, Rochester, N.Y.

[21] Appl. No.: 310,720

[22] Filed: Oct. 13, 1981

[51] Int. Cl.[3] ..... G03C 1/40; G03C 7/00; G03C 5/54

[52] U.S. Cl. ..... 430/213; 430/214; 430/215; 430/236; 430/238; 430/941

[58] Field of Search ..... 430/213, 214, 215, 941, 430/236, 238

[56] References Cited

U.S. PATENT DOCUMENTS

| | | | |
|---|---|---|---|
| 4,234,671 | 11/1980 | Iwama et al. | 430/213 |
| 4,282,305 | 8/1981 | Brust et al. | 430/213 |
| 4,299,895 | 11/1981 | Archie et al. | 430/213 |

*Primary Examiner*—Richard L. Schilling
*Attorney, Agent, or Firm*—Harold E. Cole

[57] ABSTRACT

Photographic elements, diffusion transfer assemblages and processes are described wherein a polymeric vehicle is employed in a metallizable dye image-receiving layer, a layer adjacent thereto or both. The polymeric vehicle comprises a cross-linked polymer derived from recurring units of an acrylamide, a 1-vinyl-2-pyrrolidone or a 2-hydroxyethyl acrylate and a cross-linkable monomer.

45 Claims, No Drawings

POLYMERIC VEHICLE FOR METALLIZABLE DYE IMAGE-RECEIVING LAYER

This invention relates to photography, and more particularly to color diffusion transfer photography employing metallizable dye image-providing materials. Dye images are obtained in a dye image-receiving layer which has a source of metal ions associated therewith, either in that layer or in a layer adjacent thereto. The polymeric vehicle for the dye image-receiving layer or adjacent layer comprises a cross-linked polymer derived from recurring units of an acrylamide, a 1-vinyl-2-pyrrolidone or a 2-hydroxyethyl acrylate and a cross-linkable monomer.

In U.S. Pat. No. 4,142,891 of Baigrie et al, various nondiffusible azo dye-releasing compounds are disclosed which release a diffusible tridentate azo dye ligand upon photographic processing. This tridentate ligand will form a coordination complex in the dye image-receiving layer with polyvalent metal ions. The metal ions can be present in the image-receiving layer or in a layer adjacent thereto, or the image-receiving layer can be contacted with metal ions in a bath after diffusion of the dye has taken place.

A problem exists, however, where the reaction of the dye with metal ions takes place in gelatin. The problem is that gelatin can also react with metal ions (the well known "biuret reaction") to produce an undesirable stain. For example, $Cu^{+2}$ and gelatin form a purple complex and $Ni^{+2}$ and gelatin form a yellow-colored complex at a pH > 10. These nonimagewise stains in the receiving layer remain until the pH drops below about 10. This pH drop may take up to 10 minutes in integral formats and may not even occur at all in certain peel-apart formats which have a post-processing pH > 10. It would be highly desirable to provide a substitute for gelatin in the dye image-receiving layer and/or adjacent layer containing metal ions which does not undergo the biuret reaction with metal ions at a pH > 10.

U.S. Pat. Nos. 3,721,558, 3,986,875 and 3,625,691 disclose the use of various polymeric materials for the binder in a dye image-receiving layer including polyacrylamide and polyvinyl pyrrolidone. U.S. Pat. No. 3,325,283 discloses the use of polyvinyl pyrrolidone and polyvinyl hydrogen phthalate in a layer adjacent to the image-receiving layer. There is no disclosure in these patents, however, of using metal ions in these layers to form a coordination complex with metallizable dyes or that the particular materials disclosed herein do not undergo the biuret reaction with metal ions.

U.S. Pat. No. 3,623,878 discloses the use of a gelatin layer containing a hardening agent comprising a copolymer of glycidyl acrylate and a vinyl monomer including an acrylamide derivtive. U.S. Pat. No. 4,145,221 discloses a gelatin silver halide emulsion having the gelatin partially replaced with a terpolymer of an acrylate, a glycidyl acrylate and an acrylamide monomer. These patents, however, do not disclose that those materials would be useful in a dye image-receiving layer or that metal ions could be used in such a layer to form a coordination complex with metallizable dyes.

U.S. application Ser. No. 003,169, of Brust, Hamilton and Wilkes, filed Jan. 15, 1979, now U.S. Pat. No. 4,299,895, relates to receiving elements containing a source of metal ions and certain polymeric mordants. It is disclosed therein that the mordant may be coated in a layer with a hydrophilic binder. Included in the list of suitable binders are poly(acrylamide) and poly(vinylpyrrolidone). There is no disclosure in that application, however, of using a copolymer of these materials with a cross-linkable monomer as described herein. As will be shown by comparative tests hereinafter, this cross-linkable monomer is necessary to provide a layer having a higher reflectance and to have a harder coating resulting in fewer coating defects.

A photosensitive element in accordance with our invention comprises a support having thereon a dye image-receiving layer and a source of metal ions associated therewith, either in the dye image-receiving layer or in a layer adjacent thereto, and at least one photosensitive silver halide emulsion layer having associated therewith a metallizable dye image-providing material, and wherein the dye image-receiving layer or the adjacent layer or both comprises a cross-linked polymer derived from the following recurring units:

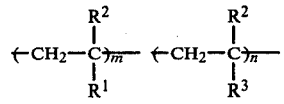

wherein:

$R^1$ is carbamoyl (—$CONH_2$), 2-oxo-1-pyrrolidinyl

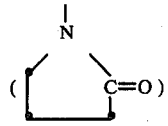

or 2-hydroxyethoxycarbonyl (—$COOCH_2CH_2OH$);

each $R^2$ is independently hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

Polymers in accordance with this formula have been found to not undergo the undesirable biuret reaction with metal ions to produce undesirable stain at pH > 10. They provide coatings with good physical integrity and also have good adhesion to layers above and below them in a photographic element.

In the above formula, $R^3$ can be any organic group having a reactive cross-linkable group, i.e., a monomer which has a functional group which readily reacts with such known cross-linking agents as aldehydes, such as formaldehyde, bisepoxides, halogenated triazines and bis(vinylsulfonyl) group-containing hardeners. In a preferred embodiment, $R^3$ can be a group containing hydroxy, an amino group (primary, secondary or tertiary amino including heterocyclic groups having basic nitrogen atoms such as imidazolyl or pyridyl), an epoxy group, an active methylene group, or mixtures thereof, with the proviso that when $R^3$ is an active methylene group, then n is about 1 to about 4 weight percent.

Active methylene groups are well known to those skilled in the art and are methylene groups between two activating groups, e.g., electronegative groups such as carbonyl. Such methylene groups exhibit unusual chemical activity and are said to be "active". Examples of compounds containing such groups include malonic esters, acetoacetic esters such as 2-(acetoacetoxyethyl) methacrylate, cyanoacetic esters and 1,3-diketones and are described in U.S. Pat. Nos. 3,459,790, 3,929,482 and 3,939,130.

Examples of the cross-linkable monomer as described above include:

2-hydroxyethyl acrylate
2-hydroxyethyl methacrylate
1-vinylimidazole
glycidyl acrylate
glycidyl methacrylate
2-aminoethyl acrylate
2-aminoethyl methacrylate
N-(2-aminoethyl)acrylamide hydrochloride
N-(3-aminopropyl)methacrylamide hydrochloride
N-(3-aminopropyl)acrylamide hydrochloride
N-allylcyanoacetamide
ethyl methacryloylacetoacetate
acryloylacetone
methacryloylacetone
2-cyanoacetoxyethyl methacrylate
N-(2-methacryloyloxyethyl)cyanoacetamide
ethyl $\alpha$-acetoacetoxymethacrylate
2-acetoacetoxypropyl methacrylate
3-acetoacetoxy-2,2-dimethylpropyl methacrylate
ethyl acryloylacetate
N-(2-acetoacetoxyethyl)acrylamide
3-methacryloyl-2,4-pentadione
N-(methacryloyloxyethyl)acetoacetamide
2-acetoacetoxyethyl methacrylate
N-t-butyl-N-(2-methacryloyloxyethyl)acetoacetamide
2- and 3-acetoacetoxypropyl acrylate
2-acetoacetoxyethyl acrylate
2-acetoacetoxy-2-methylpropyl methacrylate
ethyl methacryloylacetate
N-(3-acetoacetamidopropyl)methacrylamide
N,N-dimethylacryloylacetamide
N-cyanoacetyl-N'-methacryloylhydrazine
N-(3-methacryloyloxypropyl)cyanoacetamide
N-(2-acetoacetamidoethyl)methacrylamide In a preferred embodiment of our invention, m represents a weight percent of 90 to 99 and n represents a weight percent of 1 to 10.

Other monomers may also be present in the polymers employed in our invention as long as they do not substantially degrade the swellability, stability or other desirable physical properties of the polymer. Such other monomers include various acrylic monomers, acrylates, such as ethyl acrylate, methyl methacrylate, acrylamides such as N-isopropylacrylamide, acrylonitrile, or other monomers.

As described above, metal ions are contained either in the dye image-receiving layer or in a layer adjacent thereto. In a preferred embodiment, the metal ions are located in an adjacent layer. Metal ions most useful in the invention are those which are essentially colorless when incorporated into the image-receiving element, are inert with respect to the silver halide layers, react readily with the released dye to form a complex of the desired hue, are tightly coordinated to the dye in the complex, have a stable oxidation state, and form a dye complex which is stable to heat, light and chemical reactants. In general, good results are obtained with polyvalent metal ions such as copper(II), zinc(II), nickel(II), platinum(II), palladium(II) and cobalt(II) ions.

Depending upon the properties of the particular polymer employed in the dye image-receiving layer, a dye mordant may or may not be needed to mordant the dye. In a preferred embodiment of the invention, a dye mordant is also employed in the dye image-receiving layer. In another preferred embodiment of the invention, the dye image-receiving layer containing a dye mordant and an adjacent layer containing metal ions both contain a polymer in accordance with the formula described above.

Polymeric materials useful in our invention included within the above formula may have one or more different monomers as long as they are within the formula definitions. Polymeric materials useful in our invention include the following:

Compound 1
Poly(acrylamido-co-N-vinyl-2-pyrrolidone-co-2-acetoacetoxyethyl methacrylate) (weight ratio 19/80/1)

Compound 2
Poly(N-vinyl-2-pyrrolidone-co-2-acetoacetoxyethyl methacrylate) (weight ratio 99/1)

Compound 3
Poly(acrylamide-co-2-hydroxyethyl acrylate) (weight ratio 80/20)

Compound 4
Poly(2-hydroxyethyl methacrylate-co-acrylamide-co-2-acetoacetoxyethyl methacrylate) (weight ratio 50/48/2)

Compound 5
Poly(acrylamide-co-glycidyl acrylate) (weight ratio 90/10)

Compound 6
Poly(acrylamide-co-N-methylolacrylamide) (weight ratio 80/20)

Compound 7
Poly[acrylamide-co-2-(N,N-dimethylamino)ethyl methacrylate] (weight ratio 90/10)

Compound 8
Poly(acrylamide-co-1-vinylimidazole) weight ratio 95/5)

Compound 9
Poly[acrylamide-co-N-(3-aminopropyl)methacrylamide hydrochloride] (weight ratio 90/10)

Compound 10
Poly[acrylamide-co-N-(3-aminopropyl)methacrylamide hydrochloride] (weight ratio 95/5)

Compound 11
Poly(acrylamide-co-2-aminoethyl methacrylate hydrochloride) (weight ratio 90/10)

Compound 12
Poly(acrylamide-co-2-aminoethyl methacrylate hydrochloride) (weight ratio 95/5)

Compound 13
Poly(N-vinyl-2-pyrrolidone-co-2-aminoethyl methacrylate hydrochloride) (weight ratio 90/10)

Compound 14
Poly(2-hydroxyethyl acrylate-co-2-aminoethyl methacrylate hydrochloride) (weight ratio 90/10)

The above polymers can be prepared using conventional addition polymerization techniques well known to those skilled in the art. See, for example, U.S. Pat. No. 3,795,517, column 6, lines 43–58 and the examples disclosed therein.

The above polymers can also be hardened or cross-linked by reaction with conventional photographic hardeners well known to those skilled in the art. See, for example, *Research Disclosure,* Item 17643, December, 1978, page 26, paragraph X.

The photosensitive element described above can be treated in any manner with an alkaline processing composition to effect or initiate development. A preferred method for applying processing composition is by use of a rupturable container or pod which contains the composition. In general, the processing composition employed in this invention contains the developing agent for development, although the composition could also just be an alkaline solution where the developer is incorporated in the photographic element, image-receiving element or process sheet, in which case the alkaline solution serves to activate the incorporated developer.

A photographic assemblage in accordance with this invention is adapted to be processed by an alkaline processing composition, and comprises:

(1) a photographic element as described above; and (2) a dye image-receiving layer.

In this embodiment, the processing composition may be inserted into the assemblage, such as by interjecting processing solution with communicating members similar to hypodermic syringes which are attached either to a camera or camera cartridge. The processing composition can also be applied by means of a swab or by dipping in a bath, if so desired. Another method of applying processing composition to a film assemblage which can be used in our invention is the liquid spreading means described in U.S. application Ser. No. 143,230 of Columbus, filed Apr. 24, 1980.

In a preferred embodiment of the invention, the assemblage itself contains the alkaline processing composition and means containing same for discharge within the film unit. There can be employed, for example, a rupturable container which is adapted to be positioned during processing of the film unit so that a compressive force applied to the container by pressure-applying members, such as would be found in a camera designed for in-camera processing, will effect a discharge of the container's contents within the film unit.

The metallizable dye image-providing material useful in our invention is either positive- or negative-working, and is either initially mobile or immobile in the photographic element during processing an alkaline composition. Examples of initially mobile, positive-working metallizable dye image-providing materials useful in our invention are described in U.S. Pat. Nos. 3,196,014 and 3,081,167. Examples of negative-working metallizable dye image-providing materials useful in our invention include conventional couplers which react with oxidized aromatic primary amino color developing agents to produce or release a metallizable dye. In a preferred embodiment of our invention, the metallizable dye image-providing material is a ballasted, redox dye-releasing (RDR) compound. Such compounds are well known to those skilled in the art and are, generally speaking, compounds which will react with oxidized or unoxidized developing agent or electron transfer agent to release a dye. Such nondiffusible RDR's include positive-working and negative-working compounds, as described in U.S. Pat. Nos. 4,142,891 of Baigrie et al; 4,147,544 of Anderson et al; 4,148,641 of Green et al; 4,148,642 of Chapman et al; 4,148,643 of Chapman et al; 4,195,994 of Chapman; 4,204,870 of Chapman et al; 4,204,993 of Chapman and 4,207,104 of Chapman et al, the disclosures of which are hereby incorporated by reference.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In our invention, such a dye image-receiving layer has a source of metal ions associated therewith, either in it or in a layer adjacent thereto, and the dye image-receiving layer or adjacent layer or both comprises a polymer as described above.

When the means for discharging the processing composition is a rupturable container, it is usually positioned in relation to the photographic element and the image-receiving element described above so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the aove-described film assemblage is integral with the photographic element and is located between the support and the lowermost photosensitive silver halide emulsion layer. One useful format for integral negative-receiver photographic elements is disclosed in Belgian Pat. No. 757,960. In such an embodiment, the support for the photographic element is transparent and is coated with a dye image-receiving layer as described above, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with the dye image-receiving layer described above, a substantially opaque, light-reflective layer and the photosensitive layer or layers described above. A rupturable container, containing an alkaline processing composition and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, a neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a metallizable dye image-providing material. A dye image-receiving layer as described above would be provided on a second support with the processing composition being applied therebetween. This format could either be integral or peel-apart as described above.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

A process for producing a photographic transfer image in color according to our invention from an imagewise-exposed photosensitive element comprising a support having thereon at least one photosensitive silver halide emulsion layer having associated therewith a metallizable dye image-providing material, comprises treating the element with an alkaline processing composition in the presence of a silver halide developing agent to effect development of each of the exposed silver halide emulsion layers. An imagewise distribution of metallizable dye image-providing material is formed as a function of development and at least a portion of it diffuses to a dye image-receiving layer to provide the transfer image. The dye image-receiving layer has a source of metal ions associated therewith, either in it or in a layer adjacent thereto and the dye image-receiving layer or adjacent layer or both comprises a polymer as described previously.

The film unit or assemblage of the present invention is used to produce positive images in single or multicolors. In a three-color system, each silver halide emulsion layer of the film assembly will have associated therewith a metallizable dye image-providing material which possesses a predominant spectral absorption within the region of the visible spectrum to which said silver halide emulsion is sensitive, i.e., the blue-sensitive silver halide emulsion layer will have a yellow metallizable dye image-providing material associated therewith, the green-sensitive silver halide emulsion layer will have a magenta metallizable dye image-providing material associated therewith and the red-sensitive silver halide emulsion layer will have a cyan metallizable dye image-providing material associated therewith. The metallizable dye image-providing material associated with each silver halide emulsion layer is contained either in the silver halide emulsion layer itself or in a layer contiguous to the silver halide emulsion layer, i.e., the metallizable dye image-providing material can be coated in a separate layer underneath the silver halide emulsion layer with respect to the exposure direction.

The concentration of the metallizable dye image-providing material that is employed in the present invention can be varied over a wide range, depending upon the particular compound employed and the resulted desired. For example, the metallizable dye image-providing material coated in a layer at a concentration of 0.1 to 3 $g/m^2$ has been found to be useful. The metallizable dye image-providing material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; or phenylenediamine compounds such as N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In our invention, metallizable dye image-providing materials can be used which produce diffusible dye images as a function of development. Either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using negative-working ballasted, redox dye-releasers. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-initiated reaction to release the dye imagewise as a function of the imagewise exposure of each of the silver halide emulsion layes. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different color, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any mordant is useful in the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably processing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference. When carbon black is employed in the processing composition, various surface modifications can be employed to reduce the dye-carbon interaction. For example, the carbon black can be treated with nitric acid or by polymerization of a polymer in the presence of a carbon dispersion. Suitable polymers include, for example, a copolymer of hydrophobic monomers such as an alkyl (meth)acrylate, styrene, p-vinyltoluene or vinylbenzylchloride with a hydrophobic monomer such as 2-hydroxyethyl acrylate, acrylamide, acrylic acid, or 2-acrylamido-2-methylpropanesulfonic acid.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference. *Research Disclosure* and *Product Licensing Index* are publications of Industrial Opportunities Ltd.; Homewell, Havant; Hampshire, P09 1EF, United Kingdom.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1—MEASUREMENT OF STAIN FORMATION

Polymeric vehicles within the scope of this invention were evaluated with regard to stain formation by coating a polyethylene-coated paper support with a layer comprising a polymer as shown in Table I below at 2.16 g/m$^2$, the mordant poly(styrene-co-N-benzyl-N,N-dimethyl-N-vinylbenzylammonium chloride-co-divinylbenzene) at 2.16 g/m$^2$ and one of the copper salts identified in Table I.

The reflection density to red, green and blue light was measured on each sample both before and after immersion in a 0.5 N potassium hydroxide solution. The following results were obtained:

TABLE I

| | | | Coating Reflection Density | | | | | |
|---|---|---|---|---|---|---|---|---|
| | | | Original | | | Dens. Increase w/.5N KOH | | |
| Vehicle | Hardener | Copper Salt (g/m$^2$) | R | G | B | R | G | B |
| Pigskin Gel. | 2% BVSME* | .55 $CuSO_4$ | .08 | .08 | .08 | .05 | .09 | .02 |
| | | | | | | (Purple color-biuret reaction) | | |
| Pigskin Gel. | 2% BVSME* | .36 $CuC_2O_4$ | .08 | .08 | .08 | .05 | .07 | .01 |
| | | | | | | (Purple color-biuret reaction) | | |
| Cmpd. 1 | 2% $CH_2O$ | .55 $CuSO_4$ | .09 | .09 | .09 | .04 | 0.0 | 0.0 |
| Cmpd. 1 | 2% $CH_2O$ | .36 $CuC_2O_4$ | .09 | .09 | .09 | .06 | .02 | .02 |
| Cmpd. 3 | 2% $CH_2O$ | .55 $CuSO_4$ | .10 | .09 | .09 | .04 | .02 | .01 |
| Cmpd. 3 | 2% $CH_2O$ | .36 $CuC_2O_4$ | .07 | .07 | .08 | .05 | .03 | .01 |
| Cmpd. 5 | 2% $CH_2O$ | .55 $CuSO_4$ | .09 | .07 | .07 | .03 | .01 | .01 |
| Cmpd. 5 | 2% $CH_2O$ | .36 $CuC_2O_4$ | .09 | .08 | .07 | .04 | 0.0 | .02 |
| Cmpd. 7 | 10% BGE** | .36 $CuC_2O_4$ | .08 | .08 | .07 | .03 | 0.0 | 0.0 |

*BVSME is bis(vinylsulfonyl)methyl ether
**BGE is 1,4-butanediol diglycidyl ether The above results indicate that the polymeric vehicles of our invention containing metal ions have much less color or stain at a high pH and do not undergo the biuret reaction with metal ions as does gelatin.

EXAMPLE 2—RECEIVING ELEMENT (A) A control receiving element, part of an integral imaging receiver, was prepared by coating the following layers in the order recited on a transparent poly(ethylene terephthalate) film support. Coverages are parenthetically given in g/m$^2$.

(1) metal ion source of nickel sulfate hexahydrate (0.54), gelatin (1.1) and hardener bis(vinylsulfonyl)-methyl ether (0.022);

(2) image-receiving layer of poly(4-vinylpyridine (2.2), gelatin (2.2) and hardener bis(vinylsulfonyl)-methyl ether (0.011);

(3) reflecting layer of titanium dioxide (20) and gelatin (2.6);

(4) opaque layer of carbon black (1.9) and gelatin (1.2); and (5) overcoat of gelatin (1.2).

(B) Another receiving element was prepared in accordance with our invention which was similar to (A) except for layers (1) and (2) as follows:

(1) metal ion source of nickel nitrate hexahydrate (0.65), compound 8 (1.1) and formaldehyde hardener (0.022); and (2) image-receiving layer of poly(4-vinylpyridine) (2.2), compound 8 (2.2), and formaldehyde hardener (0.022).

A cover sheet was prepared by coating the following layers in the order recited on a poly(ethylene terephthalate) film support:

(1) an acid layer comprising poly(n-butyl acrylate-co-acrylic acid) (30:70 weight ratio equivalent to 140 meq. acid/$m^2$); and (2) a timing layer comprising a mixture of (a) cellulose acetate (40% acetyl) (10.5) and (b) poly(styrene-co-maleic anhydride) (50:50 weight ratio) (0.32).

Samples of the above receiving elements were then processed by rupturing a pod containing:

potassium hydroxide: 60 g/l carboxymethylcellulose: 42 g/l between the elements and the cover sheet described above by using a pair of juxtaposed rollers. At 30 seconds, 10 minutes and 20 minutes, the percent reflectance of the support side of the receiver was read with a scanning spectrophotometer and compared at 450, 550 and 650 nm in Table II. The reflectance of the unprocessed (raw stock) samples was also read.

TABLE II

| Receiver | Dye Image Receiving Layer Vehicle | nm | Percent Reflectance 30 sec | 10 min | 20 min | Raw Stock |
|---|---|---|---|---|---|---|
| A (Control) | Gelatin | 450 | 64 | 65 | 67 | 77 |
| | | 550 | 77 | 78 | 78 | 78 |
| | | 650 | 79 | 79 | 80 | 74 |
| B | Compound 8 | 450 | 76 | 77 | 77 | 77 |
| | | 550 | 80 | 80 | 80 | 78 |
| | | 650 | 76 | 77 | 77 | 73 |

The above data indicate that the control element has acquired a significant yellow stain as shown by the low reflectance values at 450 nm. The element of the invention, however, did not acquire any yellow biuret stain and was more nearly neutral, as shown by the more nearly equal transmittance values at the three wavelengths.

EXAMPLE 3—RECEIVING ELEMENT (A) A control receiving element was prepared by coating the following layers in the order recited on a transparent poly(ethylene terephthalate) film support. Coverages are parenthetically given in g/$m^2$.

(1) metal ion source of nickel sulfate hexahydrate (0.58) and gelatin (1.1);

(2) image-receiving layer of poly(4-vinylpyridine (2.2), gelatin (2.2) and hardener bis(vinylsulfonyl)methane (0.02);

(3) reflecting layer of titanium dioxide (19.0) and gelatin (3.0); and (4) opaque layer of carbon black (1.9) and gelatin (1.2).

(B) Another receiving element prepared in accordance with our invention which was similar to (A) except for layers (1) and (2) as follows:

(1) metal ion source of nickel sulfate hexahydrate (0.58), compound 8 (1.1) and formaldehyde (0.011); and (2) image-receiving layer of poly(4-vinylpyridine (2.2) and compound 8 (2.2).

(C) Another receiving element was prepared similar to (A) except that in layer 1, copper sulfate pentahydrate (0.55) was employed instead of the nickel compound.

(D) Another receiving element was prepared similar to (B) except that in layer 1, copper sulfate pentahydrate (0.55) was employed instead of the nickel compound.

A cover sheet was prepared by coating the following layers in the order recited on a poly(ethylene terephthalate) film support:

(1) an acid layer comprising poly(n-butyl acrylate-co-acrylic acid) (30:70 weight ratio) (equivalent to 140 meq. acid/$m^2$); and (2) a timing layer comprising a mixture of (a) cellulose acetate (40% acetyl) (10.1) and (b) poly(styrene-co-maleic anhydride) (50:50 weight ratio) (0.7) and 5-(2-cyanoethylthio)-1-phenyltetrazole (0.11).

Samples of the above receiving elements were then processed by rupturing a pod containing:

potassium hydroxide: 60 g/l carboxymethylcellulose: 40 g/l between the elements and the cover sheet described above by using a pair of juxtaposed rollers. At the periods of time shown in Table III, the density on the support side of the receiver was read on a scanning spectrophotometer. The magnitude of the stain formed is evaluated by comparing the density at the wavelength maximum of the particular stain (450 or 550 nm) produced by the alkaline solution versus that for a 40 g/l carboxymethyl cellulose-water solution. The following results were obtained.

TABLE III

| Receiver | Vehicle | Metal | Reflection Density Water Soln. 80 sec | Alkaline Solution 80 sec | 10.5 min | 1 hour |
|---|---|---|---|---|---|---|
| A | Gelatin | Ni(II)* | 0.08 | 0.17 | 0.15 | 0.07 |
| B | Cmpd. 8 | Ni(II)* | 0.09 | 0.10 | 0.09 | 0.07 |
| C | Gelatin | Cu(II)** | 0.13 | 0.22 | 0.21 | 0.13 |
| D | Cmpd. 8 | Cu(II)** | 0.15 | 0.16 | 0.16 | 0.09 |

*Ni(II) - gelatin stain read at 450 nm.
**Cu(II) - gelatin stain read at 550 nm.

The above results show a substantial nickel and copper biuret stain at both 80 seconds and 10.5 minutes when gelatin is used as the vehicle, while a negligible amount of stain was obtained in using Compound 8 in accordance with our invention. Although the stain in elements A and C decreases after one hour as the pH is lowered, due to dissociation of the metal-biuret complex, the short-term stain is still a hinderance to viewing and judging an image at that time.

EXAMPLE 4—RECEIVING ELEMENT (A) A control receiving element was prepared by coating the following layers in the order recited on a transparent poly(ethylene terephthalate) film support. Coverages are parenthetically given in g/$m^2$.

(1) metal ion source of nickel sulfate hexahydrate (0.58), gelatin (1.8) and bis(vinylsulfonyl)methane (0.01);
(2) image-receiving layer of poly(4-vinylpyridine (2.2), gelatin (2.2) and hardener bis(vinylsulfonyl)methane (0.02);
(3) reflecting layer of titanium dioxide (19.0) and gelatin (1.9);
(4) opaque layer of carbon black (1.9) and gelatin (1.2); and
(5) overcoat layer of gelatin (1.2).

(B) Another control element prepared similar to (A) except that no nickel salt was employed.

(C–H) Receiving elements C, D, E, F, G and H were prepared in accordance with our invention which were similar to (A) except for layers (1) and (2) as follows:
(1) metal ion source of nickel nitrate hexahydrate (0.65), compound according to Table IV (1.1) and formaldehyde (0.02); and
(2) image-receiving layer of poly(4-vinylpyridine (2.2), compound according to Table IV (2.2) and hardener 1,4-butanediol diglycidyl ether (0.054).

Samples of the above receiving elements were then processed in the same manner as in Example 3, employing samples of the same cover sheet and processing composition described therein. The percent reflectance was read within 30 seconds and again at 30 minutes on a scanning spectrophotometer and recorded as a function of wavelength as follows:

TABLE IV

| | | % Reflectance @ 30 sec | | | % Reflectance @ 30 mins | | |
|---|---|---|---|---|---|---|---|
| Receiver | Vehicle | 440 nm | 500 nm | 620 nm | 440 nm | 500 nm | 620 nm |
| A (Control) | Gelatin | 63 | 70 | 80 | 65 | 72 | 79 |
| B (Control) | Gelatin (no Ni(II)) | 79 | 83 | 82 | 78 | 82 | 81 |
| C | Cmpd. 9 | 78 | 82 | 80 | 77 | 81 | 79 |
| D | Cmpd. 10 | 77 | 81 | 80 | 76 | 81 | 79 |
| E | Cmpd. 11 | 77 | 80 | 80 | 77 | 80 | 79 |
| F | Cmpd. 12 | 77 | 81 | 79 | 77 | 81 | 79 |
| G | Cmpd. 13 | 75 | 81 | 81 | 76 | 81 | 81 |
| H | Cmpd. 14 | 77 | 80 | 80 | 77 | 80 | 79 |

The above results show a substantial nickel biuret stain at both 30 seconds (63 and 70% reflectance) and 30 minutes (65 and 72% reflectance) when gelatin is used as the vehicle. The elements employing the compounds in accordance with our invention, however, exhibit minimum stain as shown by a constant and high percent reflectance at the three tabulated wavelengths.

EXAMPLE 5—PHOTOSENSITIVE ELEMENT (A) A control integral imaging receiver (IIR) was prepared by coating the following layers in the order recited on a transparent poly(ethylene terephthalate) film support. Coverages are parenthetically given in g/m$^2$ unless otherwise stated.
(1) metal ion source of nickel sulfate hexahydrate (0.58), a gelatin (1.8) and bis(vinylsulfonyl)methane (0.01);
(2) image-receiving layer of poly(4-vinylpyridine (2.2), gelatin (2.2) and hardener bis(vinylsulfonyl)methane (0.02);
(3) reflecting layer of titanium dioxide (19.0) and gelatin (1.9);
(4) opaque layer of carbon black (1.9) and gelatin (1.2);
(5) interlayer of gelatin (1.2);
(6) blue-sensitive negative silver iodobromide emulsion (1.4 Ag), gelatin (2.2), yellow, positive-working RDR (0.46), reducing agent (0.45) and inhibitor (0.02); and
(7) overcoat of gelatin (1.3).

Yellow RDR

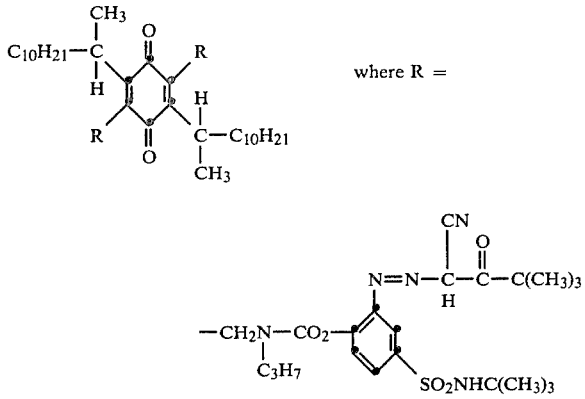

(dispersed in diethyllauramide 2:1)

Reducing Agent

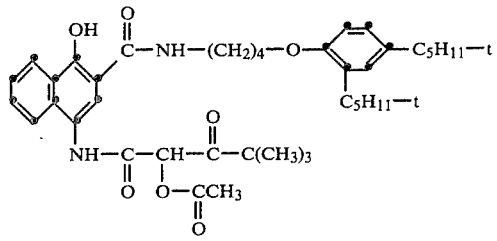

(dispersed in diethyllauramide 2:1)

Inhibitor

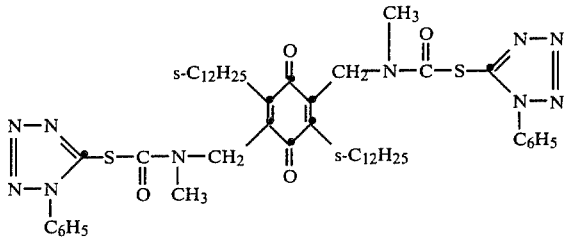

(dispersed in diethyllauramide 2:1)

(B–E) IIR elements B, C, D and E were prepared in accordance with our invention which were similar to (A) except for layers (1) and (2) as follows:
(1) metal ion source of nickel nitrate hexahydrate (0.65), compound according to Table V (1.1) and formaldehyde (0.02); and
(2) image-receiving layer of poly(4-vinylpyridine (2.2), compound according to Table V (2.2) and hardener 1,4-butanediol diglycidyl ether (0.054).

Samples of the above IIR's elements were exposed in a sensitometer through a graduated test object. The exposed samples were then processed by rupturing a pod containing:

| | |
|---|---|
| Potassium hydroxide | 60 g/l |
| 4-Hydroxymethyl-4-methyl-1-tolyl-3-pyrazolidinone | 12 g/l |
| Potassium bromide | 5 g/l |
| Ethylenediaminetetra-acetic acid, disodium salt | 10 g/l |
| Sodium sulfite | 2 g/l |
| Carboxymethyl cellulose | 56 g/l |
| Carbon | 172 g/l |
| Tamol SN ® (Trademark) surfactant | 2.2 g/l |

between the exposed samples and the cover sheet of Example 3 by using a pair of juxtaposed rollers. After a period of not less than one hour, the Status A blue density of the receiver side of the element was read with the following results:

TABLE V

| IIR | Vehicle | Status A Blue Density $D_{min}$ | Status A Blue Density $D_{max}$ | Relative Log Speed at D = 1.0 |
|---|---|---|---|---|
| A (Control) | Gelatin | 0.18 | 1.57 | 65 |
| B | Cmpd. 9 | 0.18 | 1.59 | 63 |
| C | Cmpd. 10 | 0.19 | 1.65 | 59 |
| D | Cmpd. 11 | 0.18 | 1.58 | 59 |
| E | Cmpd. 12 | 0.18 | 1.62 | 58 |

The above results indicate that the vehicles employed in our invention may be directly substituted for gelatin without any substantial loss of sensitometric values.

EXAMPLE 6—COMPARISON TESTS (A) A control receiving element, part of an integral imaging receiver, was prepared by coating the following layers in the order recited on a transparent poly(ethylene terephthalate) film support. Coverages are parenthetically given in g/m$^2$.

(1) metal ion source of nickel nitrate hexahydrate (0.65), poly(acrylamide) (1.1) and hardener formaldehyde (0.022);

(2) image-receiving layer of poly(4-vinylpyridine (2.2) and poly(acrylamide) (2.2);

(3) reflecting layer of titanium dioxide (19) and gelatin (3.0);

(4) opaque layer of carbon black (1.9) and gelatin (1.2); and (5) overcoat of gelatin (1.2).

(B) Another control receiving element was prepared which was similar to (A) except for layers (1) and (2) as follows:

(1) metal ion source of nickel nitrate hexahydrate (0.65), poly(N-vinyl-2-pyrrolidone) (1.1) and formaldehyde hardener (0.022); and (2) image-receiving layer of poly(4-vinylpyridine) (2.2) and poly(N-vinyl-2-pyrrolidone) (2.2).

(C) Another receiving element was prepared in accordance with the invention which was similar to (A) except for layers (1) and (2) as follows:

(1) metal ion source of nickel nitrate hexahydrate (0.65), compound 10 (1.1) and formaldehyde hardener (0.011); and (2) image-receiving layer of poly(4-vinylpyridine) (2.2) and compound 10 (2.2).

The Status A reflection densities of these three coatings were measured through the support as follows:

| Receiver | Vehicle | Reflection Densities Red | Green | Blue |
|---|---|---|---|---|
| A (Control) | Poly(acrylamide) | 0.15 | 0.12 | 0.11 |
| B (Control) | Poly(N—vinyl-2-pyrrolidone) | 0.11 | 0.09 | 0.09 |
| C | Compound 10 | 0.10 | 0.08 | 0.08 |

The above data indicate that the receiver prepared in accordance with our invention had the highest reflectance when compared to receivers having polymers without any cross-linkable monomer. This is, in effect, a measurement of background or "raw stock" density-lower numbers being the most desirable. In addition, there were coating defects observed with the two control coatings. Receiver A had a "rough-surface" appearing opaque layer and black spots were visible through the reflecting layer which accounts for its decrease in reflectance (increased density). Receiver B had a non-uniform "pebbly" appearance and its reflectance was lower also. The receiver in accordance with our invention had the fewest number of coating defects.

EXAMPLE 7—COMPARISON TESTS FOR HARDNESS

Hardness measurements were made on supports having layers (1) and (2) only of the receiver of Example 6. A force in grams was measured for a given diameter stylus to "scribe through" the image-receiving layer wet with water. As the surface hardness increases, more force is required to "open" the surface by scribing. The following results were obtained:

| Vehicle in Layers 1 and 2 of Receiver | Force to Scribe (g) Stylus Diameter 0.4 mm | 1.2 mm |
|---|---|---|
| Poly(acrylamide) | 3.0 | 7.0 |
| Poly(N—vinyl-2-pyrrolidone) | * | * |
| Compound 10 | 32.0 | 61.0 |

*No resistance, coating "lifted off" when scribed.

The above data indicate that the coating in accordance with our invention is much harder in comparison to polymers without any cross-linkable monomer. A harder coating is more desirable to produce a firmer substrate for the other layers to be coated thereover, resulting in fewer coating defects.

The invention has been described in detail with particular reference to preferred embodiments thereof, but it will be understood that variations and modifications can be effected within the spirit and scope of the invention.

What is claimed is:

1. In a photographic element comprising a support having thereon a dye image-receiving layer and a source of metal ions associated therewith, either in said dye image-receiving layer or in a layer adjacent thereto, and at least one photosensitive silver halide emulsion layer having associated therewith a metallizable dye image-providing material, the improvement wherein said dye image-receiving layer or said adjacent layer or both comprises a cross-linked polymer derived from the following recurring units:

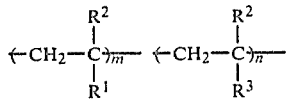

wherein:

$R^1$ is carbamoyl, 2-oxo-1-pyrrolidinyl or 2-hydroxyethoxycarbonyl;

each $R^2$ is hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

2. The photographic element of claim 1 wherein $R^3$ is a group containing a hydroxy, amino, epoxy, an active methylene group or mixtures thereof, with the proviso that when $R^3$ is a group containing an active methylene group, then n is about 1 to about 4 weight percent.

3. The photographic element of claim 1 wherein said dye image-receiving layer also contains a dye mordant.

4. In the photographic element of claim 1, the further improvement wherein said dye image-receiving layer comprises said polymer.

5. In the photographic element of claim 1, the further improvement wherein both said dye image-receiving layer and said adjacent layer comprises said polymer.

6. The photographic element of claim 1 wherein $R^1$ is carbamoyl.

7. The photographic element of claim 1 wherein $R^1$ is 2-oxo-1-pyrrolidinyl.

8. The photographic element of claim 1 wherein $R^1$ is 2-hydroxyethoxycarbonyl.

9. The photographic element of claim 1 wherein said polymer comprises poly[acrylamide-co-N-(3-aminopropyl)methacrylamide hydrochloride] (weight ratio 95/5).

10. The photographic element of claim 1 wherein said polymer comprises poly(acrylamide-co-1-vinylimidazole) (weight ratio 95:5).

11. The photographic element of claim 1 which comprises said support having thereon a red-sensitive silver halide emulsion layer having a metallizable cyan dye image-providing material associated therewith, a green-sensitive silver halide emulsion layer having a metallizable magenta dye image-providing material associated therewith, and a blue-sensitive silver halide emulsion layer having a metallizable yellow dye image-providing material associated therewith.

12. In a photographic assemblage comprising:

(a) a support having thereon at least one photosensitive silver halide emulsion layer having associated therewith a metallizable dye image-providing material; and (b) a dye image-receiving layer and a source of metal ions associated therewith, either in said dye image-receiving layer or in a layer adjacent thereto, the improvement wherein said dye image-receiving layer or said adjacent layer or both comprises a cross-linked polymer derived from the following recurring units:

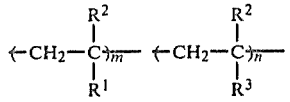

wherein:

$R^1$ is carbamoyl, 2-oxo-1-pyrrolidinyl or 2-hydroxyethoxycarbonyl;

each $R^2$ is hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

13. The assemblage of claim 12 wherein $R^3$ is a group containing a hydroxy, amino, epoxy, an active methylene group or mixtures thereof, with the proviso that when $R^3$ is a group containing an active methylene group, then n is about 1 to about 4 weight percent.

14. In a photographic assemblage comprising (a) a photosensitive element comprising a support having thereon at least one photosensitive silver halide emulsion layer having associated therewith a metallizable dye image-providing material;

(b) a dye image-receiving layer and a source of metal ions associated therewith, either in said dye image-receiving layer or in a layer adjacent thereto; and (c) an alkaline processing composition and means containing same for discharge within said assemblage;

the improvement wherein said dye image-receiving layer or said adjacent layer or both comprises a cross-linked polymer derived from the following recurring units:

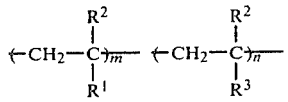

wherein:

$R^1$ is carbamoyl, 2-oxo-1-pyrrolidinyl or 2-hydroxyethoxycarbonyl;

each $R^2$ is hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

15. The assemblage of claim 14 wherein $R^3$ is a group containing a hydroxy, amino, epoxy, an active methylene group or mixtures thereof, with the proviso that when $R^3$ is a group containing an active methylene group, then n is about 1 to about 4 weight percent.

16. The assemblage of claim 14 wherein said dye image-receiving layer also contains a dye mordant.

17. In the assemblage of claim 14, the further improvement wherein said dye image-receiving layer comprises said polymer.

18. In the assemblage of claim 14, the further improvement wherein both said dye image-receiving layer and said adjacent layer comprises said polymer.

19. The assemblage of claim 14 wherein $R^1$ is carbamoyl.

20. The assemblage of claim 14 wherein $R^1$ is 2-oxo-1-pyrrolidinyl.

21. The assemblage of claim 14 wherein $R^1$ is 2-hydroxyethoxycarbonyl.

22. The assemblage of claim 14 wherein said polymer comprises poly[acrylamide-co-N-(3-aminopropyl)methacrylamide hydrochloride] (weight ratio 95/5).

23. The assemblage of claim 14 wherein said polymer comprises poly(acrylamide-co-1-vinylimidazole) (weight ratio 95:5).

24. The assemblage of claim 14 wherein (a) said dye image-receiving layer is located in said photosensitive element between said support and said silver halide emulsion layer; and (b) said assemblage also includes a transparent cover sheet over the layer outermost from said support.

25. The assemblage of claim 24 wherein said transparent cover sheet is coated with, in sequence, a neutralizing layer and a timing layer.

26. The assemblage of claim 25 wherein said discharging means is a rupturable container containing said alkaline processing composition and an opacifying agent, said container being so positioned during processing of said assemblage that a compressive force applied to said container will effect a discharge of the container's contents between said transparent cover sheet and the layer outermost from said support.

27. The assemblage of claim 14 wherein said support of said photosensitive element is opaque, and said dye image-receiving layer is located on a separate transparent support superposed on the layer outermost from said opaque support.

28. The assemblage of claim 27 wherein said transparent support has thereon, in sequence, a neutralizing layer, a timing layer and said dye image-receiving layer.

29. The assemblage of claim 27 wherein said opaque support has thereon, in sequence, a neutralizing layer, a timing layer and said silver halide emulsion layer.

30. The assemblage of claim 14 wherein said dye image-providing material is a redox dye-releaser.

31. The assemblage of claim 14 wherein said photosensitive element comprises a support having thereon a red-sensitive silver halide emulsion layer having a metallizable cyan dye image-providing material associated therewith, a green-sensitive silver halide emulsion layer having a metallizable magenta dye image-providing material associated therewith, and a blue-sensitive silver halide emulsion layer having a yellow metallizable dye image-providing material associated therewith.

32. In an integral photographic assemblage comprising (a) a photosensitive element comprising a transparent support having thereon the following layers in sequence: a dye image-receiving layer having a source of metal ions associated therewith, either in said dye image-receiving layer or in a layer adjacent thereto; an alkaline solution-permeable, light-reflective layer; an alkaline solution-permeable, opaque layer; a red-sensitive, direct-positive silver halide emulsion layer having a ballasted metallizable redox cyan dye-releaser associated therewith; a green-sensitive, direct-positive silver halide emulsion layer having a ballasted metallizable redox magenta dye-releaser associated therewith; and a blue-sensitive, direct-positive silver halide emulsion layer having a ballasted metallizable redox yellow dye-releaser associated therewith;

(b) a transparent sheet superposed over said blue-sensitive silver halide emulsion layer and comprising a transparent support coated with, in sequence, a neutralizing layer and a timing layer; and (c) a rupturable container containing an alkaline processing composition and an opacifying agent, said container being so positioned during processing of said assemblage that a compressive force applied to said container will effect a discharge of the container's contents between said transparent sheet and said blue-sensitive silver halide emulsion layer;

said assemblage containing a silver halide developing agent, the improvement wherein said dye image-receiving layer or said adjacent layer or both comprises a cross-linked polymer derived from the following recurring units:

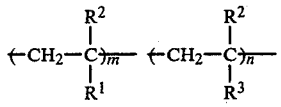

wherein:

$R^1$ is carbamoyl, 2-oxo-1-pyrrolidinyl or 2-hydroxyethoxycarbonyl;

each $R^2$ is hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

33. The assemblage of claim 32 wherein $R^3$ is a group containing a hydroxy, amino, epoxy, an active methylene group or mixtures thereof, with the proviso that when $R^3$ is a group containing an active methylene group, then n is about 1 to about 4 weight percent.

34. In a photographic element comprising a support having thereon a dye image-receiving layer and a source of metal ions associated therewith, either in said dye image-receiving layer or in a layer adjacent thereto, said metal ions being capable of reacting with a released dye to form a metal-dye complex, the improvement wherein said dye image-receiving layer or said adjacent layer or both comprises a cross-linked polymer derived from the following recurring units:

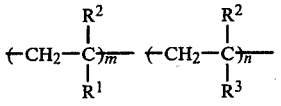

wherein:

$R^1$ is carbamoyl, 2-oxo-1-pyrrolidinyl or 2-hydroxyethoxycarbonyl;

each $R^2$ is hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

35. The photographic element of claim 34 wherein $R^3$ is a group containing a hydroxy, amino, epoxy, an active methylene group or mixtures thereof, with the proviso that when $R^3$ is a group containing an active methylene group, then n is about 1 to about 4 weight percent.

36. The photographic element of claim 34 wherein said dye image-receiving layer also contains a dye mordant.

37. In the photographic element of claim 34, the further improvement wherein said dye image-receiving layer comprises said polymer.

38. In the photographic element of claim 34, the further improvement wherein both said dye image-receiving layer and said adjacent layer comprises said polymer.

39. The photographic element of claim 34 wherein $R^1$ is carbamoyl.

40. The photographic element of claim 34 wherein $R^1$ is 2-oxo-1-pyrrolidinyl.

41. The photographic element of claim 34 wherein $R^1$ is 2-hydroxyethoxycarbonyl.

42. The photographic element of claim 34 wherein said polymer comprises poly[acrylamide-co-N-(3-aminopropyl)methacrylamide hydrochloride] (weight ratio 95/5).

43. The photographic element of claim 34 wherein said polymer comprises poly(acrylamide-co-1-vinylimidazole) (weight ratio 95:5).

44. In a process for producing a photographic transfer image in color from an imagewise-exposed photosensitive element comprising a support having thereon at least one photosensitive silver halide emulsion layer having associated therewith a metallizable dye image-providing material, said process comprising treating said element with an alkaline processing composition in the presence of a silver halide developing agent to effect development of each of said exposed silver halide emulsion layers, whereby an imagewise distribution of metallizable dye image-providing material is formed as a function of development and at least a portion of it diffuses to a dye image-receiving layer to provide said transfer image, said dye image-receiving layer having a source of metal ions associated therewith, either in said dye image-receiving layer or in a layer adjacent thereto, the improvement wherein said dye image-receiving layer or said adjacent layer or both comprises a cross-linked polymer derived from the following recurring units:

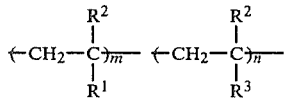

wherein:

$R^1$ is carbamoyl, 2-oxo-1-pyrrolidinyl or 2-hydroxyethoxycarbonyl;

each $R^2$ is hydrogen or methyl;

$R^3$ is an organic group having a reactive cross-linkable group;

m represents a weight percent of about 75 to about 99; and n represents a weight percent of about 1 to about 25;

with the proviso that when $R^1$ is 2-hydroxyethoxycarbonyl, then $R^3$ is an organic group having a reactive cross-linkable group other than a hydroxyalkoxycarbonyl group.

45. The process of claim 44 wherein $R^3$ is a group containing a hydroxy, amino, epoxy, an active methylene group or mixtures thereof, with the proviso that when $R^3$ is a group containing an active methylene group, then n is about 1 to about 4 weight percent.

* * * * *